US007568702B2

(12) United States Patent
Holden et al.

(10) Patent No.: US 7,568,702 B2
(45) Date of Patent: Aug. 4, 2009

(54) FOLDING CHESS SET

(76) Inventors: William Holden, 1015 E. Second Ave., Durango, CO (US) 81301; Charlie Holden, 204 Barry St., Decatur, GA (US) 30030

( * ) Notice: Subject to any disclaimer, the term of this patent is extended or adjusted under 35 U.S.C. 154(b) by 0 days.

(21) Appl. No.: 11/462,098

(22) Filed: Aug. 3, 2006

(65) Prior Publication Data

US 2007/0102881 A1 May 10, 2007

Related U.S. Application Data

(60) Provisional application No. 60/704,887, filed on Aug. 3, 2005.

(51) Int. Cl.
*A63F 3/00* (2006.01)

(52) U.S. Cl. ..... 273/285; 273/287

(58) Field of Classification Search ..... 273/285, 273/287, 283, 284; D21/335, 336, 337
See application file for complete search history.

(56) References Cited

U.S. PATENT DOCUMENTS

| | | | | |
|---|---|---|---|---|
| 1,754,130 | A * | 4/1930 | Uchiyama | 273/285 |
| 2,023,830 | A * | 12/1935 | Dusinberre | 108/99 |
| 2,075,354 | A * | 3/1937 | Namee | 108/131 |
| 2,084,912 | A * | 6/1937 | Klep | 273/282.1 |
| 2,827,352 | A * | 3/1958 | Boyajian | 190/12 R |
| 4,371,168 | A | 2/1983 | Dupuis | |
| D268,850 | S | 5/1983 | Vukadinovic | |
| 4,513,974 | A | 4/1985 | Lin | |
| 4,534,565 | A * | 8/1985 | Hube | 273/241 |
| 6,196,546 | B1 * | 3/2001 | Iglesias | 273/285 |

* cited by examiner

*Primary Examiner*—Vishu K. Mendiratta
(74) *Attorney, Agent, or Firm*—Bradford Kile; Scott Houtteman; Kile Goekjian Reed & Mc Manus PLLC

(57) ABSTRACT

Chess set comprising a housing that closes and creates a space to store game pieces. Shelves are rotatably attached to the side of the board to move from a close position inside the housing to an open position adjacent to the playing board. Game pieces are adhered to the shelves and to the board via a mechanical connection that is releasable such as a magnet, button, adhesive, or other suitable mechanism.

6 Claims, 8 Drawing Sheets

FOLDING CHESS SET

This application claims benefit of U.S. Provisional Patent Application Ser. No. 60/704,887 filed Aug. 3, 2005.

BACKGROUND OF THE INVENTION

Prior art chess sets have had various problems. Among others, chess pieces can easily be lost; the large bulky game board can be difficult to store; and also difficult to transport. Other prior art chess sets have attempted to solve this problem by making smaller, portable game boards and game pieces. However, these sets have had their own problems. It can be difficult to keep playing pieces on the board and once a piece is off the board, it is difficult to store the piece and avoid loss.

SUMMARY OF THE INVENTION

In consequence of the background discussed above, and other factors that are known in the field, applicants recognized a need for an improved chess set that would allow players to easily play and maintain their chess board and pieces. Thus, the present invention relates to an improved chess set. More specifically the invention relates to a chess set in which the two halves of the playing board can be folded together to form an interior storage area. Hinged shelves are positioned at the periphery of the chess board. The shelves can swing out and reside on the sides (and/or ends) of the chess board when the board is set for play. When the game is stored, the shelves will swing in so that they can be stored in the interior of the chess board.

In one embodiment, the shelves contain metal that attracts magnets located within the chess pieces. In another aspect of the invention the shelves contain magnets and the pieces have a magnet attracting metal. The board and pieces can be made from wood, metal, plastic, or any other suitable material. There can be a variety of configurations for the shelves and a variable number of shelves.

DETAILED DESCRIPTION

Figure 1:
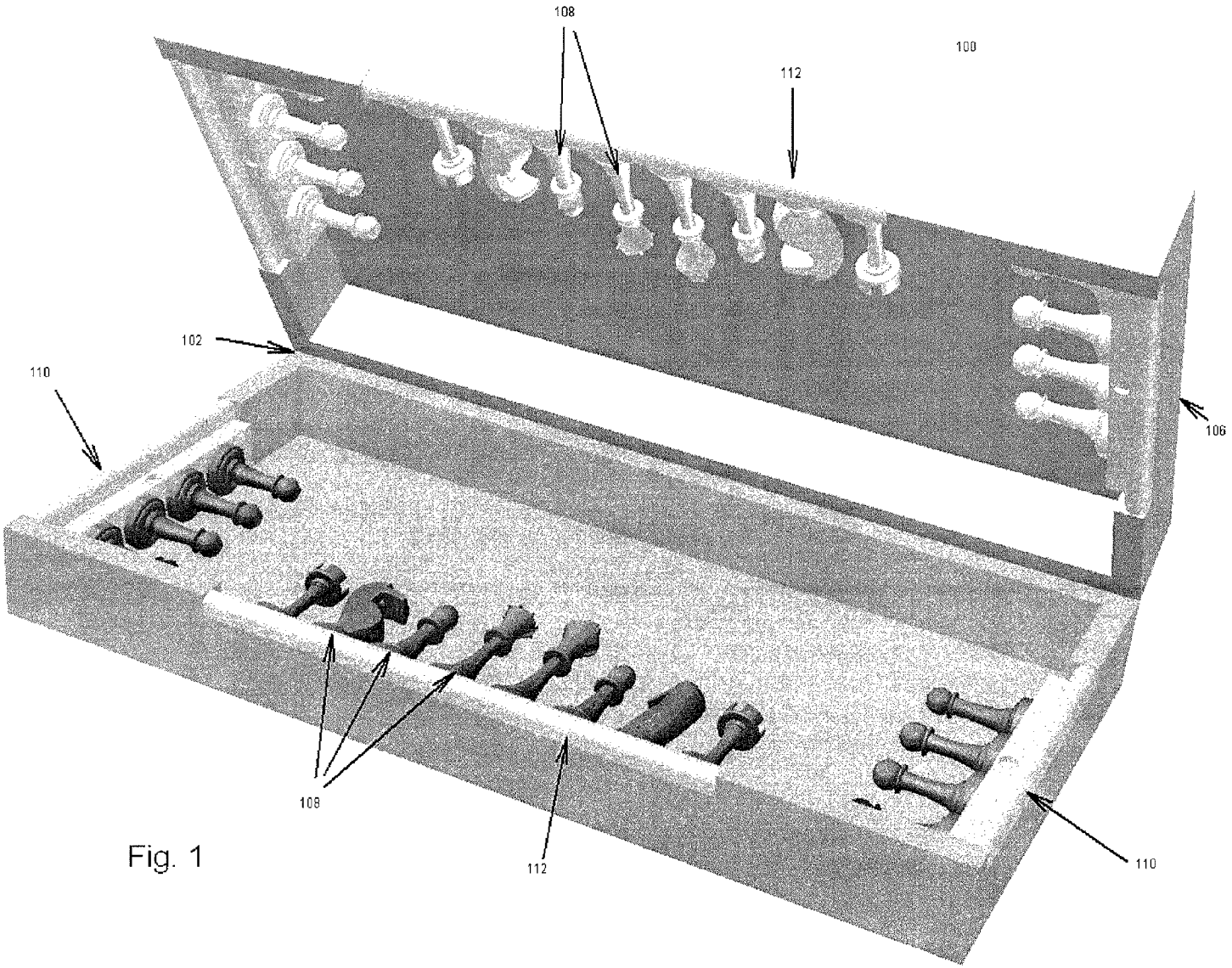
FIG. 1 is a perspective view of the partially closed chess set of the subject invention.

Turning now to the drawings and particularly to FIG. 1, wherein like numerals indicate like parts, there is shown a perspective view of the chess set 100 of the subject invention. The board can be folded in two to form an interior space out of the hollow region. Furthermore, the shelves can be designed so that they fold under the board and the chess pieces on the shelves can be stored in the interior space. Hinge mechanism 102 holds the two sides of the set together and allows for rotation from a closed position to an open position and vice versa. When closed, the chess set provides protection and storage for a plurality of game pieces 108. Front shelves 112 and side shelves 110 can be rotated on a hinge to move from the closed position shown to a position appropriate for play. The top side of the board 106 (not shown) is the actual game play board. The board, shelves, and game pieces may be constructed of any number of materials including wood, metal, or plastic. Additionally, it is not necessary for all pieces to be constructed of the same material.

Figure 2:
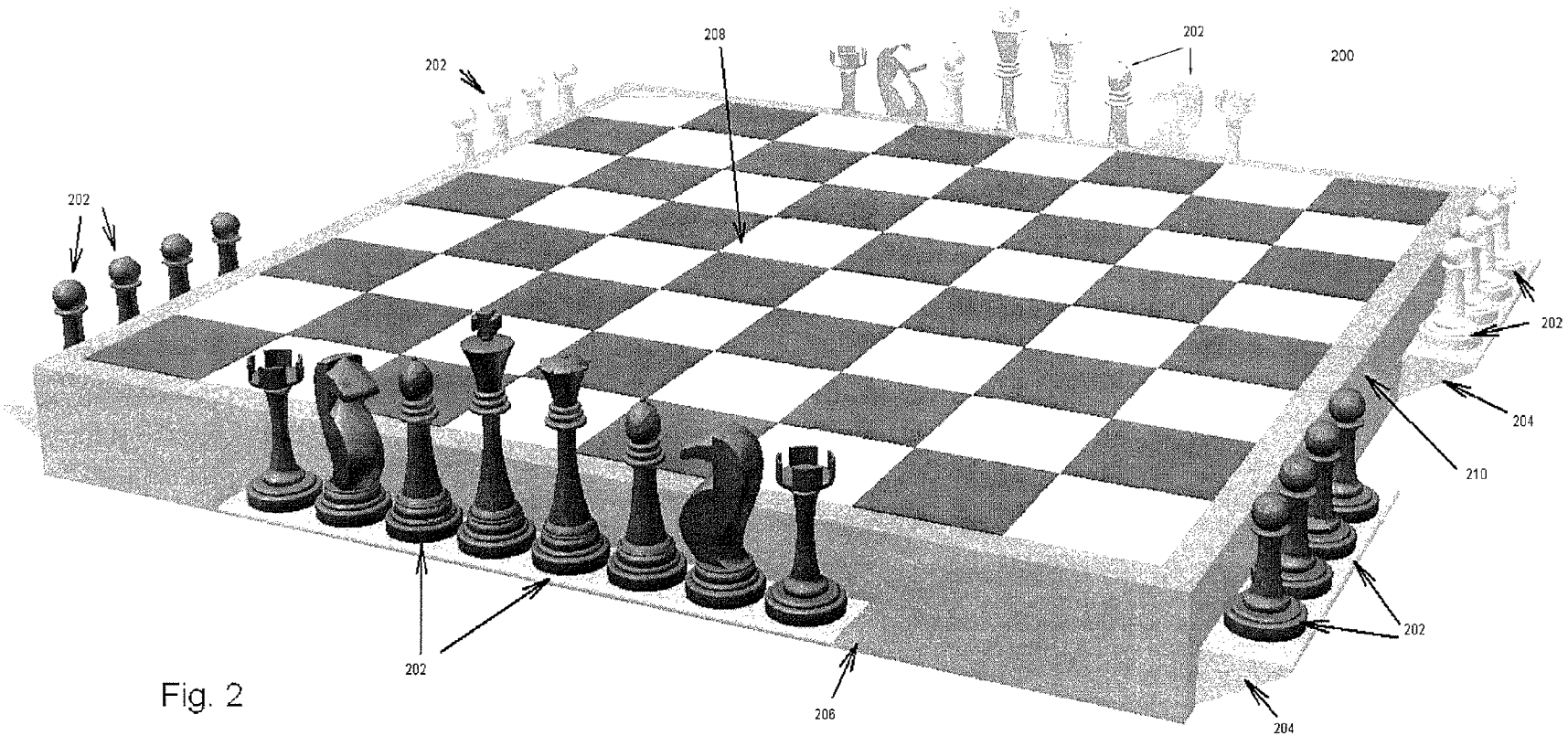
FIG. 2 is a perspective view of the board with game pieces placed on hinged shelves.

Turning to FIG. 2, the chess set 200 of the subject invention is shown fully open with shelves in the open position. Game pieces 202 rest on the shelves that have been turned on hinges from their closed position, shown in FIG. 1, to this open position. The shelves may be configured to sit below the level of the playing board or level with the playing board. Game surface 208 contains either a single large magnet or metal element, or a plurality of magnet or metal elements to correspond to either magnet or metal elements in each of the game pieces 202. If the game board is metal then the game pieces will contain magnet elements. If the game board comprises one or more magnets on its surface then the game pieces will comprise metal elements to allow them to be removably adhered to the board during play. These magnets can be hidden inside the body of the game piece or the board. This connection prevents loss of game pieces and difficulty in playing if game pieces were to shift. Any type of connection mechanism would be useful. Other examples include velcro, buttons, or a host of other male/female type releasable connections. Front shelves 206 and side shelves 204 hold any of the game pieces; although the illustration shows a particular placement of game pieces, any configuration would be possible. The game board, when unfolded, meets at point 210. There may be some mechanical attachment such as a magnet to hold the two pieces in place.

An alternative magnetized embodiment comprises a board that is magnetized to some degree and attracts a metal element in the game piece. At the center of each square on the game board, there is a hidden magnetized element that is greater in mass than the magnet covering the spaces between the centers of the squares. This feature causes the game pieces to "snap" into position and adds greater security. This may also be accomplished by creating a metal board of a given thickness and having a metal "plug" of a greater thickness under the center of each square. A magnet element in the game pieces will "snap" into position above these metal "plugs."

Figure 3:
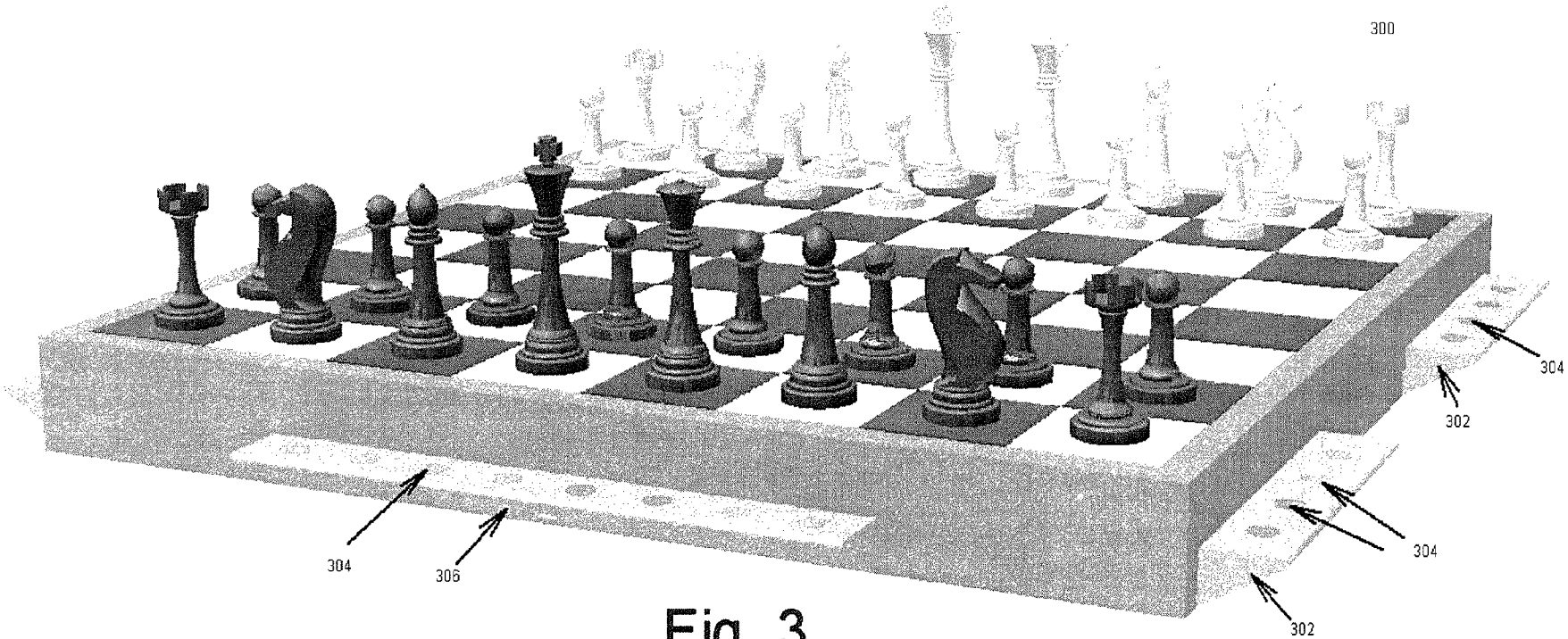
FIG. 3 is a perspective view of the board at the commencement of the game.

FIG. 3 shows a perspective view of the chess set 300 of the subject invention. Side shelves 302 and front shelves 306 have been emptied and the game pieces are on the board in their appropriate places for the start of the game. Connection elements 304 may be a magnet to correspond to metal in the game pieces or metal to correspond to a magnet in the game pieces. The game pieces or shelves may also be constructed entirely of the magnetic or metal material. This connection does not have to be magnetic, alternatively, it may be any removable mechanical connection such as velcro, snap buttons, or a releasable male/female connector.

Figure 4:
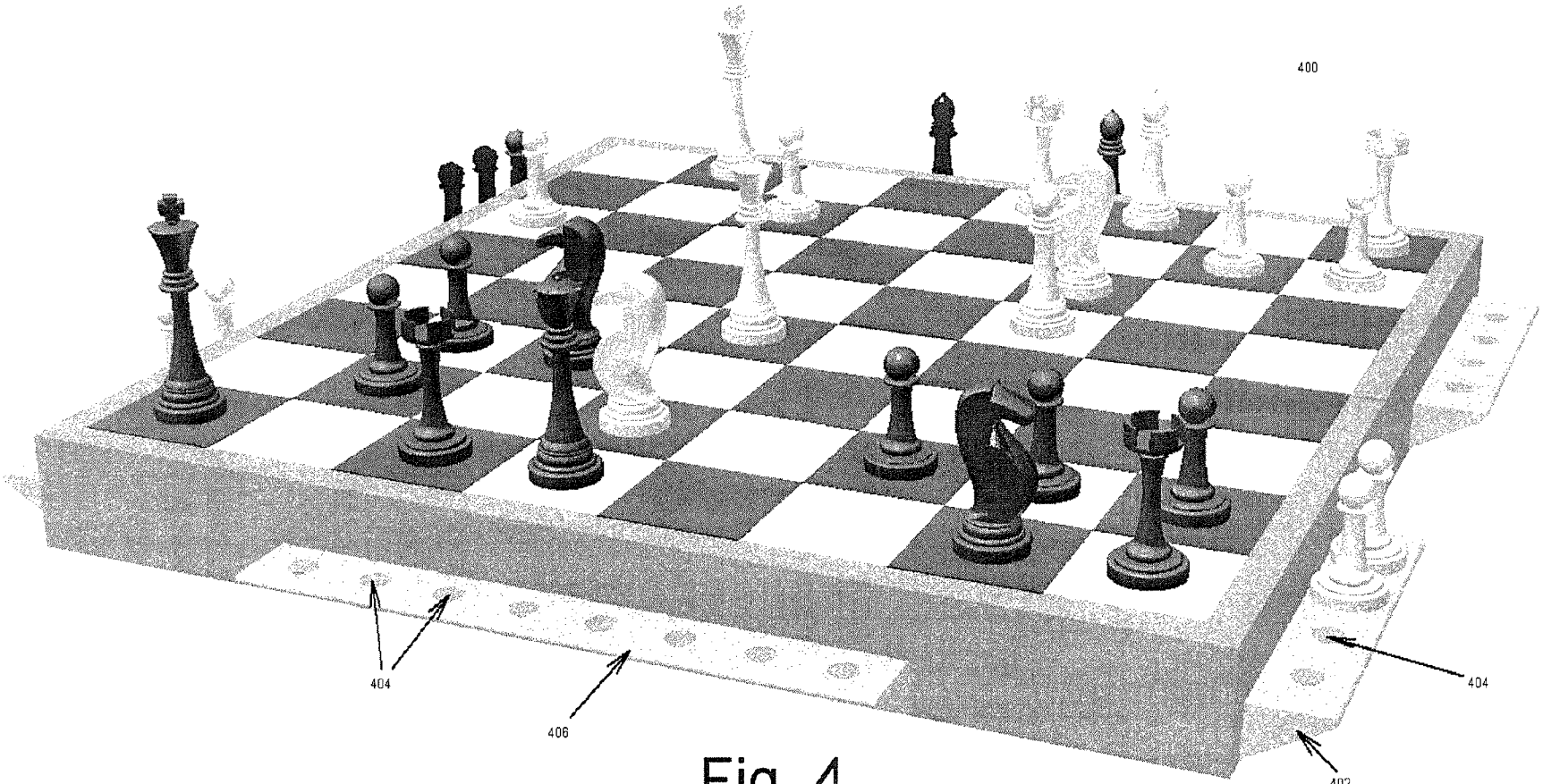
FIG. 4 is a perspective view of the board during game play.

FIG. 4 is a perspective view of the chess set 400 of the subject invention during game play. As can be seen, the captured pieces can be replaced on side shelves 402 and front shelves 406 during play to allow all players to easily see which pieces are no longer in play. Mechanical connection mechanisms 404, as described above, may be corresponding metal/magnet pairs, snap buttons, or any other releasable connection.

Figure 5:
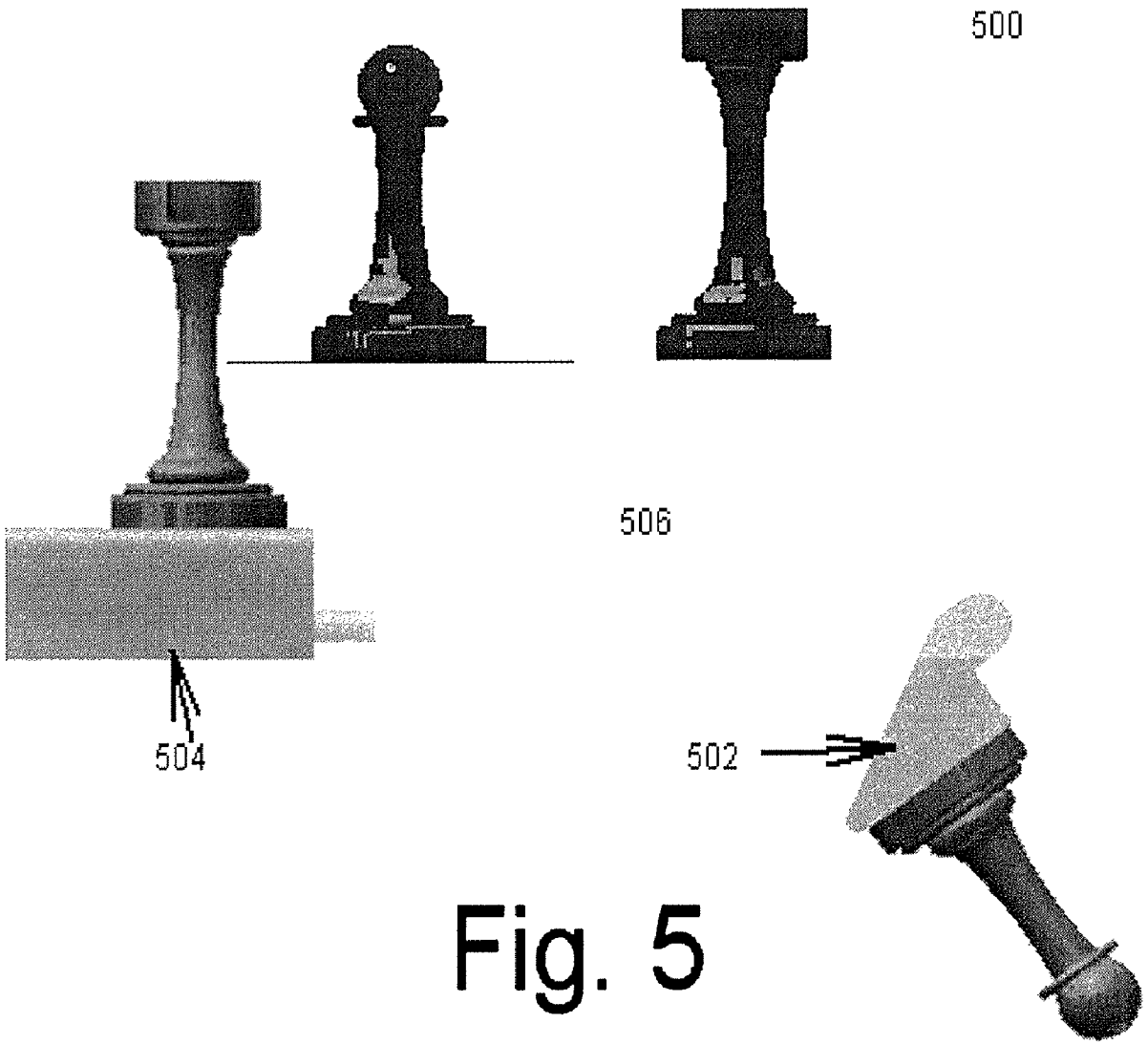
FIG. 5 is a side view of the chess set with one shelf partially open.

Turning to FIG. 5, a side view of the chess set 500 of the subject invention is shown. The front edge of 506 is facing with front shelf 504 turned into place for play. Side shelf 502 is partially rotated between the closed position and the open position. Note that when open or closed, the shelves may be mechanically connected to the board by magnets, snaps, or other connection to hold them in place during play or storage. In this embodiment the shelves' closed position comprises swings down and under the chess board so that pieces can be stored under the board facing horizontally and thus protected from damage by dropping or contact with hard objects.

Figure 6:
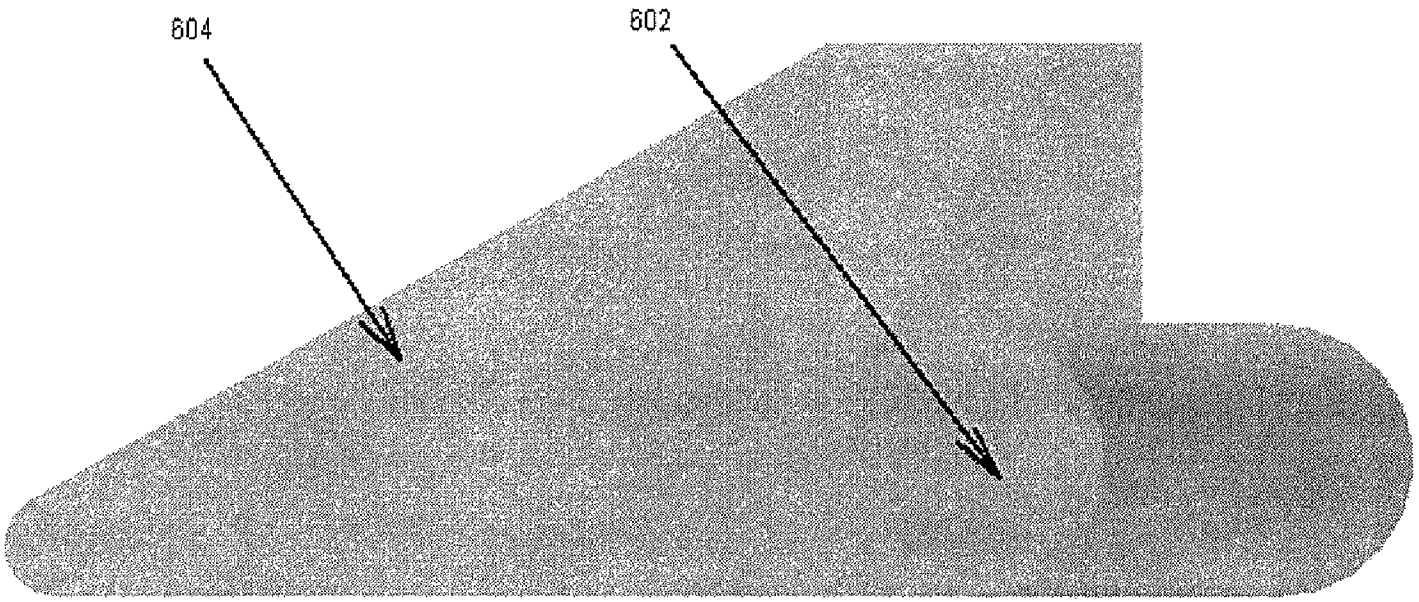
FIG. 6 is a schematic view of one embodiment comprising a slanted shelf configuration.

FIG. 6 shows a cutaway view of an alternative embodiment using a slanted shelf. Shelf 604 is rotated along hinge axis 602 between a closed and open position.

Figure 7:
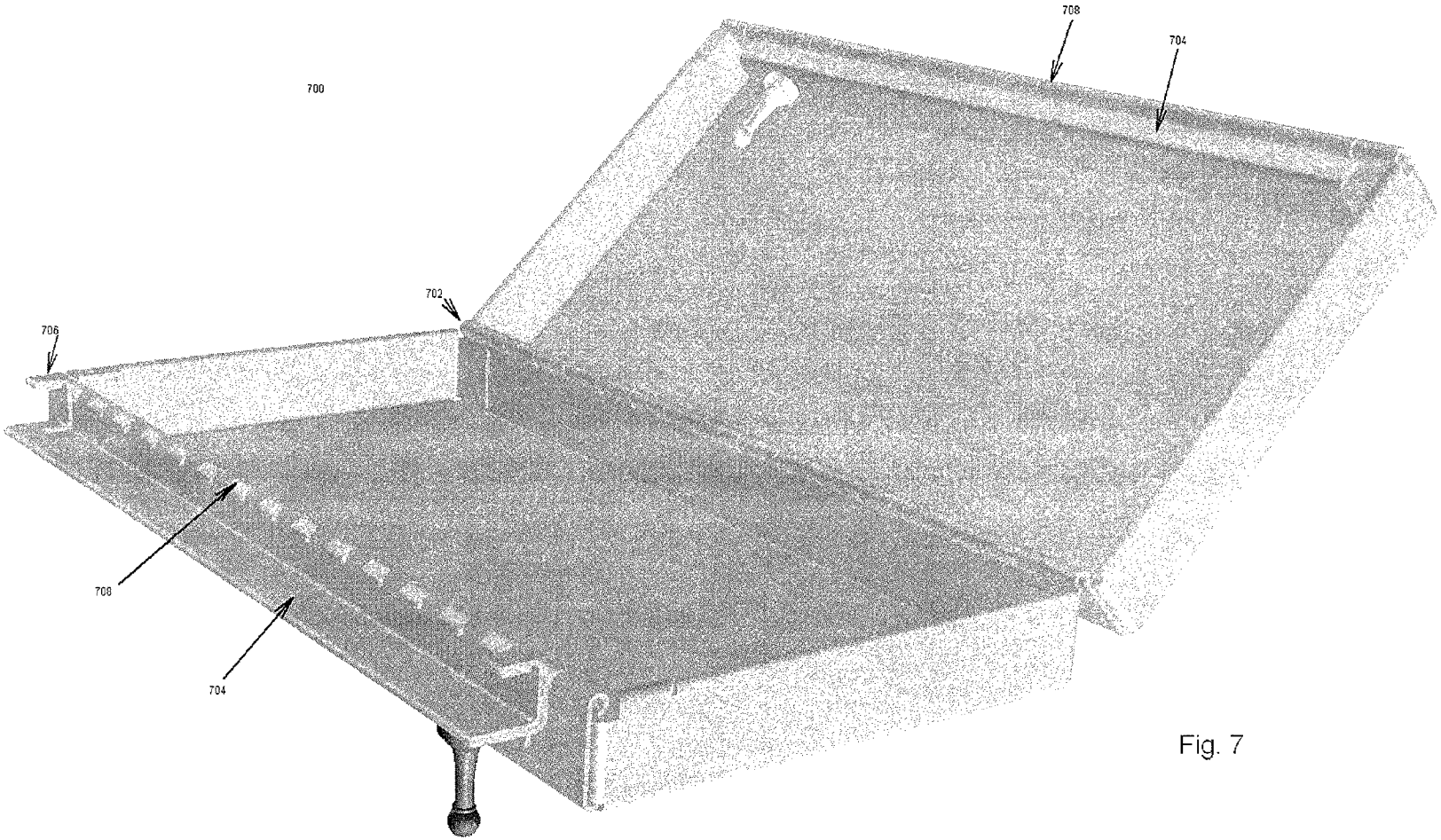
FIG. 7 is a perspective view of the subject invention utilizing a particular shelf configuration with feet.

FIG. 7 shows an alternative embodiment of the chess set 700. This set is constructed entirely of metal and the game pieces would have magnet elemerts to cause them to adhere to the shelves and game playing surface. The board opens at point 702 using a hinge mechanism. Shelves 704 close to allow game pieces to be stored horizontally inside the chess set and open to allow for game play. This embodiment shows only two front shelves but there may be two front and two side shelves as shown above. The shelves each have optional feet 706 that cause the shelves to remain open when the open chess set is placed on a flat surface.

Figure 8:
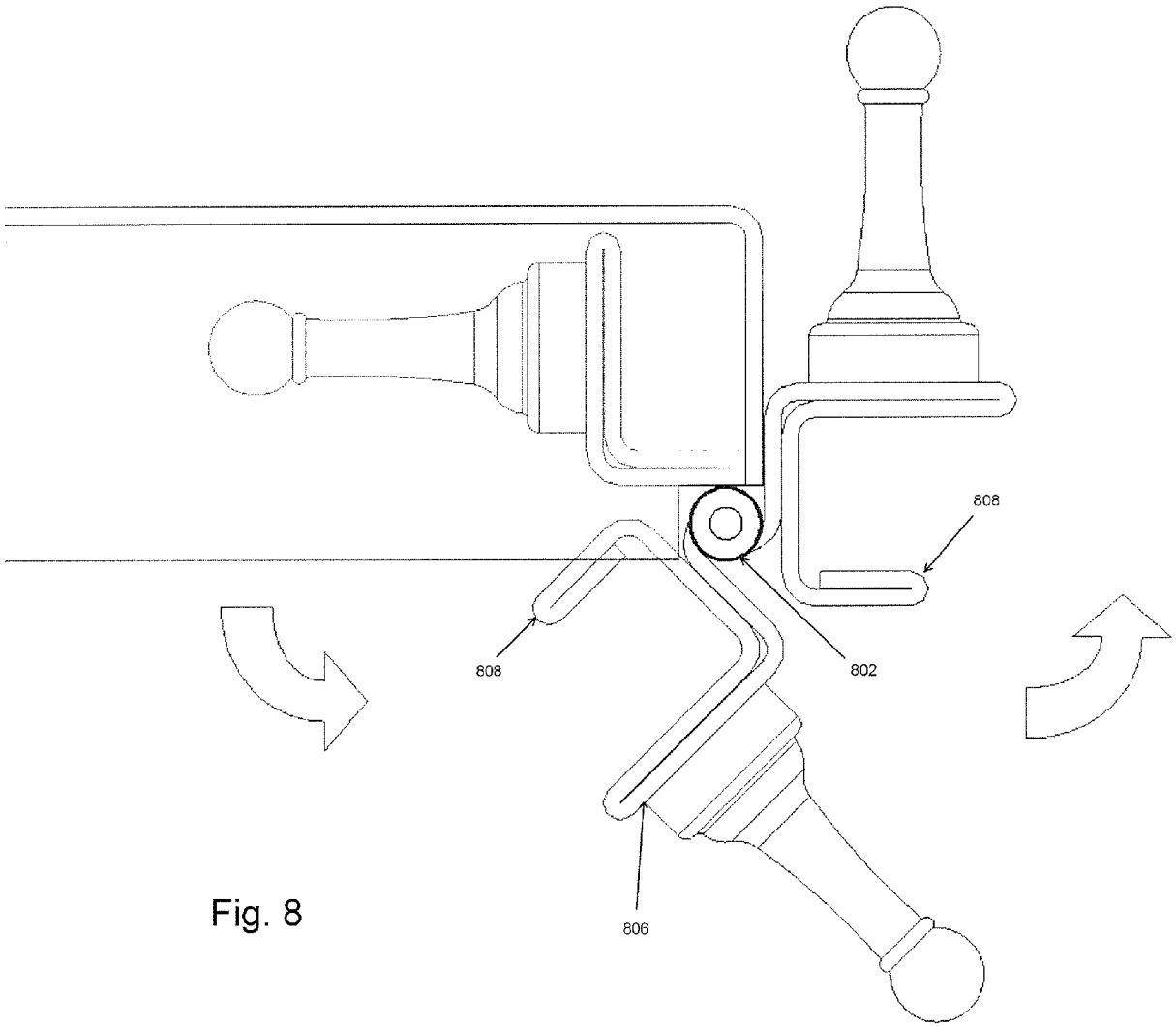
FIG. 8 is schematic view of the hinge mechanism for folding the shelves from storage position to play position and vice versa.

FIG. 8 shows a side schematic view of the chess set illustrating the movement of a shelf from a closed position, through its rotation, to the open position with a game piece connected. The shelf rotates along hinge axis 802. This hinge can be any appropriate hinge configuration that allows for free rotation. The game piece is magnetically attached in this embodiment at point 806. Foot 808 operates as described above to hold the shelf stable when the board is placed on a flat surface.

The preceding description has been presented only to illustrate and describe the invention and some examples of its implementation. It is not intended to be exhaustive or to limit the invention to any precise form disclosed. Many modifications and variations are possible and would be envisioned by one of ordinary skill in the art in light of the above description and drawings.

The various aspects were chosen and described in order to best explain principles of the invention and its practical applications. The preceding description is intended to enable others skilled in the art to best utilize the invention in various embodiments and aspects and with various modifications as are suited to the particular use contemplated.

What is claimed is:

1. A collapsible chess set comprising:

a generally square chess board having a playing surface with an eight by eight playing grid formed by alternate colored squares on the grid surface to form a chess board playing surface, said chess board having a central transverse dividing the chess board into two rectangular halves forming a first half and an essentially identical second half;

a first peripheral wall connected to said first rectangular half of said chess board and extending beneath and away from the playing surface of said first half of said chess board;

a second peripheral wall connected to said second rectangular half of said chess board and extending beneath and away from the playing surface of said second half of said chess board;

a hinge connected to a first long edge of said first peripheral wall of said first rectangular half of said chess board and also connected to a first long edge of said second peripheral wall of said second rectangular half of said chess board such that said first half and said second half of said chess board can be pivoted from a closed rectangular box configuration to an open generally square playing surface configuration;

a first shelf pivotally connected to a second long edge of said first peripheral wall of said first rectangular half of said chess board and being operable to pivot from a closed position within said first peripheral wall, with a generally flat surface of said first shelf generally parallel with an inner surface of said first peripheral wall, to an open position approximately two hundred and seventy degrees from said closed position wherein said first shelf is outside of said first peripheral wall and said first shelf surface being generally parallel with said chess board playing surface;

a second shelf pivotally connected to a second long edge of said second peripheral wall of said second rectangular half of said chess board and being operable to pivot from a closed position within said second peripheral wall with a generally flat surface of said second shelf generally parallel with an inner surface of said second peripheral wall, to an open position approximately two hundred and seventy degrees from said closed position wherein said second shelf is outside of said second peripheral wall and said second shelf surface being generally parallel with said chess board playing surface;

removable attachment mechanisms attaching chess pieces to the generally flat surface of said first and second shelves, wherein chess pieces can be operably connected to said shelves and said chess board halves being operable to be folded together into a rectangular box storage configuration and then selectively opened and the shelves pivoted outward and the chess pieces selectively placed upon the playing board to start play and then returned to the shelves as play proceeds.

2. The collapsible chess set as defined by claim 1 further comprising:

a third and a fourth shelf pivotally connected to opposite short edges of said first peripheral wall of said first rectangular half of said chess board and being operable to pivot from a closed position within said first peripheral wall, with generally flat surfaces of said third and fourth shelves generally parallel with an inner surface of said first peripheral wall, to an open position approximately two hundred and seventy degrees from said closed position wherein said third and fourth shelves are outside of said first peripheral wall and said third and fourth shelve surfaces being generally parallel with said chess board playing surface; and, a fifth and a sixth shelf pivotally connected to opposite short edges of said second peripheral wall of said second rectangular half of said chess board and being operable to pivot from a closed position within said second peripheral wall, with generally flat surfaces of said fifth and sixth shelves generally parallel with an inner surface of said second peripheral wall, to an open position approximately two hundred and seventy degrees from said closed position wherein said fifth and sixth shelves are outside of said second peripheral wall and said fifth and sixth shelve surfaces being generally parallel with said chess board playing surface.

3. The collapsible chess set as defined by claim 2 wherein said third, fourth, fifth and sixth selves are specifically designed to hold pawns.

4. The collapsible chess set as defined by claim 1 wherein said first and second shelves are specifically designed to hold the eight major chess pieces.

5. The collapsible chess set as defined by claim 1 wherein said removable attachment mechanisms are selected from the group consisting of magnets, Velcro, buttons, snaps and male/female releasable connections.

6. The collapsible chess set as defined by claim 1 wherein said removable attachment mechanism is magnetic and said magnetic mechanism is selected from the group consisting of: magnet on chess piece with metal on shelf, magnet on shelf with metal on chess piece and an entire magnetic shelf.

* * * * *

UNITED STATES PATENT AND TRADEMARK OFFICE

CERTIFICATE OF CORRECTION

PATENT NO. : 7,568,702 B2
APPLICATION NO. : 11/462098
DATED : August 4, 2009
INVENTOR(S) : Holden et al.

It is certified that error appears in the above-identified patent and that said Letters Patent is hereby corrected as shown below:

On the title page, item [75], the address for Inventor William Holden should read:
1915 E. Second Ave.,
Durango, CO (US) 81301

Signed and Sealed this

Twentieth Day of October, 2009

David J. Kappos

David J. Kappos
*Director of the United States Patent and Trademark Office*